US008079159B1

(12) United States Patent
Rosa

(10) Patent No.: US 8,079,159 B1
(45) Date of Patent: Dec. 20, 2011

(54) FOOTWEAR

(76) Inventor: Adriano Rosa, Caledonia, MI (US)

( * ) Notice: Subject to any disclaimer, the term of this patent is extended or adjusted under 35 U.S.C. 154(b) by 952 days.

(21) Appl. No.: 12/041,958

(22) Filed: Mar. 4, 2008

Related U.S. Application Data

(60) Provisional application No. 60/893,273, filed on Mar. 6, 2007.

(51) Int. Cl.
*A43B 13/00* (2006.01)

(52) U.S. Cl. ..... 36/25 R; 36/114; 36/31

(58) Field of Classification Search ..... 36/25 R, 36/88, 91, 92, 103, 114, 31
See application file for complete search history.

(56) References Cited

U.S. PATENT DOCUMENTS 6,119,373 A * 9/2000 Gebhard et al. ..... 36/114
6,237,251 B1 * 5/2001 Litchfield et al. ..... 36/25 R
6,438,873 B1 * 8/2002 Gebhard et al. ..... 36/114
6,516,540 B2 * 2/2003 Seydel et al. ..... 36/29
6,591,519 B1 * 7/2003 Ellis, III ..... 36/25 R
6,658,766 B2 * 12/2003 Kraeuter et al. ..... 36/114
6,662,470 B2 * 12/2003 Ellis, III ..... 36/25 R
7,069,665 B1 7/2006 Adriano
2005/0210705 A1 * 9/2005 Grove et al. ..... 36/25 R
2005/0217142 A1 * 10/2005 Ellis ..... 36/25 R
2006/0213088 A1 * 9/2006 Grove et al. ..... 36/100
2007/0240331 A1 * 10/2007 Borel ..... 36/28
2008/0052965 A1 * 3/2008 Sato ..... 36/103

* cited by examiner

*Primary Examiner* — Marie Patterson
(74) *Attorney, Agent, or Firm* — McGarry Bair PC

(57) ABSTRACT

A shoe has a sole including a platform for supporting a wearer's foot upon a surface. The shoe includes a heel pedestal extending from the platform beneath a wearer's heel, a lateral stabilizer pedestal extending from the platform at least partially beneath a wearer's cuboid bone, and a medial stabilizer pedestal extending from the platform at least partially beneath a wearer's navicular bone. The heel pedestal, the lateral stabilizer pedestal, and the medial stabilizer pedestal include an outsole for contacting the surface, a compressible middle layer between the outsole and the wearer's foot, and a base layer between the middle layer and the wearer's foot having a compressibility that is lower than the compressibility of the middle layer.

10 Claims, 7 Drawing Sheets

FOOTWEAR

This application claims the benefit of U.S. provisional application Ser. No. 60/893,273, filed Mar. 6, 2007, which is incorporated herein in its entirety.

BACKGROUND OF THE INVENTION

The invention relates generally to footwear, and specifically to footwear adapted to adjust posture and gait associated with different foot physiologies.

A significant number of people require some type of insert or other orthotic device to address anomalies in foot physiology and gait. Typically, addressing such anomalies consists of no more than a static adjustment of the arch support, or stabilization of the heel, or both. Little if any attention is paid to the forefoot, or the person's gait, when addressing foot anomalies.

Merely adjusting the arch support may affect a small component of a person's gait, but it cannot properly address the component of gait associated with the forefoot, i.e. supporting full body weight on the plantar portion of the foot, and pushing off to transfer the body weight to the other foot. An arch support does little to properly control the transfer of weight from the heel to the midfoot and thence to the forefoot that occurs while taking a step.

Attempts have also been made to improve lateral stability by incorporating a lateral extension of the sole into the shoe, particularly around the heel cup. While this may provide a wider base on which to support a person's weight when standing, lateral stability is substantially reduced upon transferring weight from the heel to the forefoot while taking a step. Furthermore, a wider base cannot control the progressive transfer of weight from the heel to the forefoot, and thus cannot properly address gait.

Gait, of course, is not static. Thus, adjustments to gait must take into account the entire process of bipedal locomotion (e.g. walking, running, etc.) from the heel first hitting the ground to the toes pushing off. Known shoes, especially athletic shoes, utilize a flat heel and a square heel cup wherein the Achilles portion of the heel cup defines a generally right angle with the sole. While this configuration may center the heel with respect to the heel cup, it does not properly position the heel relative to a person's weight, and does not control the transfer of weight from the heel through the mid-foot to the forefoot. One need only inspect a few well-worn heels to observe wear patterns that frequently extend along the lateral and medial edges of the heel, indicating the off-center character of weight distribution and gait in many people.

There is a need for footwear which can address anomalies in foot physiology more effectively than conventional footwear.

SUMMARY OF THE INVENTION

In one embodiment, a shoe has a sole including a platform for supporting a wearer's foot upon a surface. The shoe includes a heel pedestal extending from the platform beneath a wearer's heel, a lateral stabilizer pedestal extending from the platform at least partially beneath a wearer's cuboid bone, and a medial stabilizer pedestal extending from the platform at least partially beneath a wearer's navicular bone. The heel pedestal, the lateral stabilizer pedestal, and the medial stabilizer pedestal include an outsole for contacting the surface, a compressible middle layer between the outsole and the wearer's foot, and a base layer between the middle layer and the wearer's foot having a compressibility that is lower than the compressibility of the middle layer.

In another embodiment, a shoe for supporting a wearer's foot upon a surface includes a sole, a lateral stabilizer pedestal, a medial stabilizer pedestal, a heel pedestal, and an array of forefoot support pads. The sole includes a forefoot portion associated with a plantar region of a wearer's foot, a midfoot portion associated with a wearer's arch, and a heel portion associated with a wearer's heel. The lateral stabilizer pedestal extends from the midfoot portion at least partially beneath a wearer's cuboid bone. The medial stabilizer pedestal extends from the midfoot portion at least partially beneath a wearer's navicular bone. The heel pedestal extends from the heel portion beneath a wearer's heel. The array of forefoot support pads includes at least a first forefoot support pad adjacent the lateral stabilizer pedestal and the medial stabilizer pedestal, and a second forefoot support pad adjacent the front of the shoe. The array of forefoot support pads is integrated into and extends from the forefoot portion. With the unworn shoe supported on a reference surface by the lateral stabilizer pedestal and the medial stabilizer pedestal, a first height is defined by a distance between the reference surface and the center of a ground contacting surface of the first forefoot support pad. Similarly, a second height is defined by a distance between the reference surface and the center of a ground contacting surface of the second forefoot support pad adjacent the front of the shoe. The second height is greater than the first height. A third height is defined by a distance between the reference surface and the center of a ground contacting surface of the heel pedestal. The third height is less than the second height. The first, second, and third heights define a longitudinal profile characterizing a forefoot rocker and a heel rocker. The heel pedestal, the medial stabilizer pedestal, and the lateral stabilizer pedestal define an integral, 3-point structure for supporting a wearer's foot.

DESCRIPTION OF AN EMBODIMENT OF THE INVENTION

Figure 1:
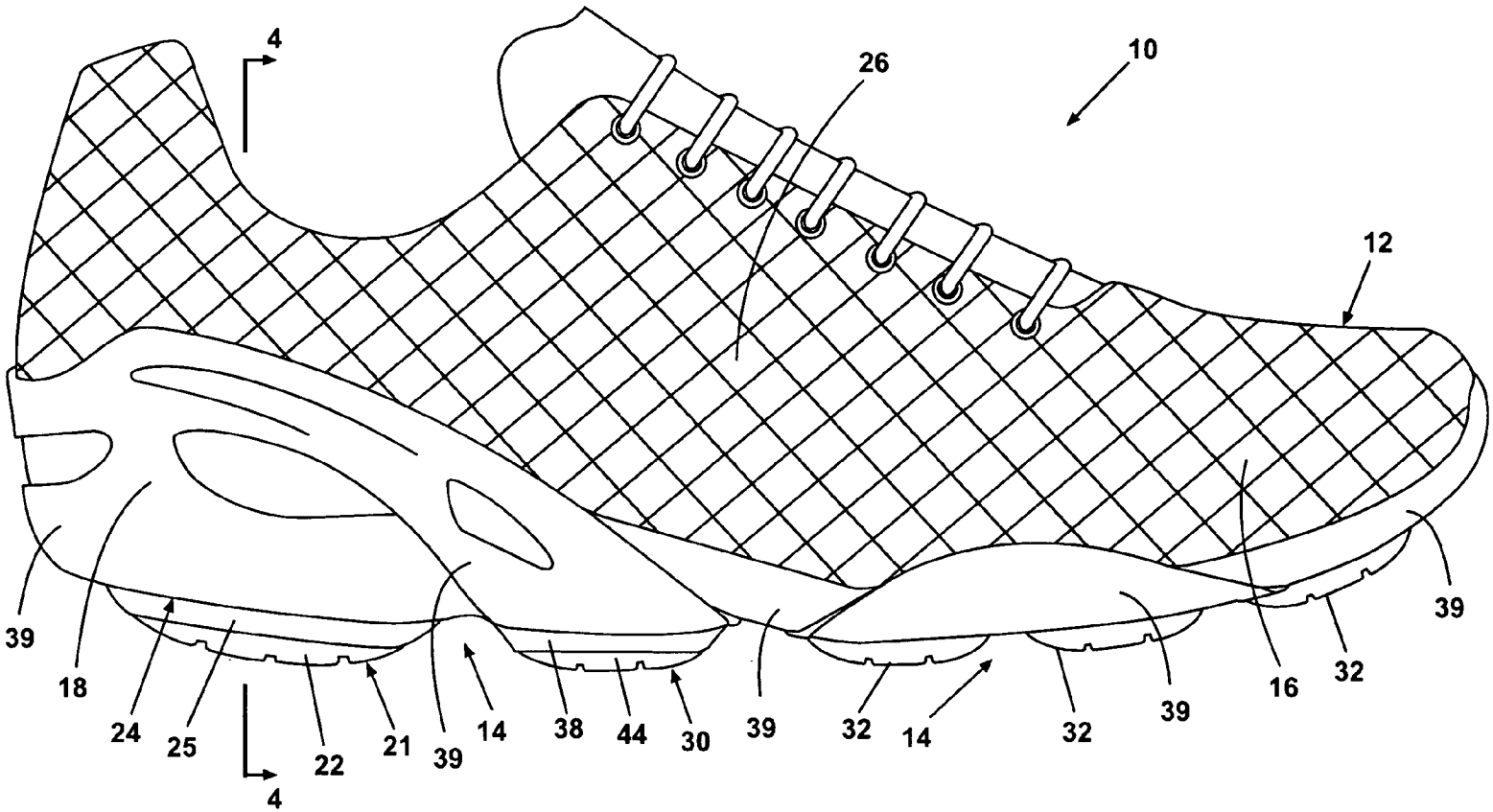
FIG. 1 is a side elevational view of an embodiment of a shoe according to the invention.

Referring to FIG. 1, an embodiment of the invention is illustrated comprising a shoe 10 having a generally known upper portion 12. The shoe 10 has a forefoot portion 16, such as a toe box, a midfoot portion 26 associated with a wearer's arch, and a heel portion 18, such as a heel cradle. The shoe 10 is illustrated as an athletic, lace-up style. However, the shoe 10 can be of any selected style.

Figure 2:
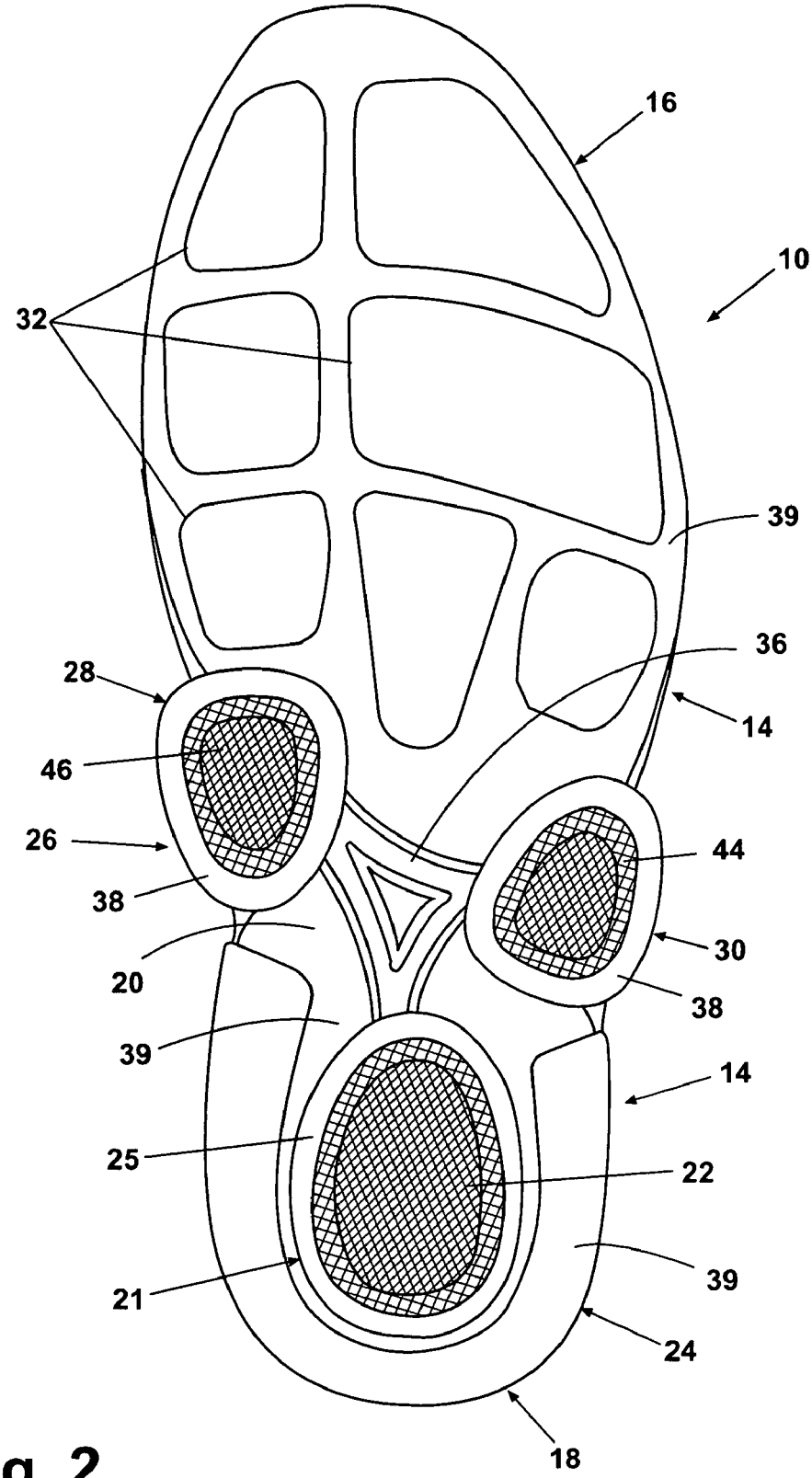
FIG. 2 is a view from the underside of the shoe illustrated in FIG. 1.

Referring also to FIG. 2, the shoe 10 has a sole 14 comprising a platform 20. The forefoot portion of the sole 14 comprises an array of forefoot support pads 32 integrated therein and extending away from the platform 20 for cushioning the forefoot, and providing fraction and lateral stability. FIG. 2 illustrates an exemplary distribution and configuration of the support pads 32. However, the configuration and distribution of the support pads 32 can be selected based upon factors such as shoe flexibility, weight distribution in the forefoot portion, degree of cushioning, and the like.

The heel portion of the sole 14 comprises a heel pedestal 21 extending away from the platform 20 and centered generally beneath the heel bone. The heel pedestal 21 is illustrated as somewhat egg-shaped in plan view, although the heel pedestal 21 can be configured with other shapes, such as circular, triangular, oval, and the like. Extending generally arcuately along the perimeter of the heel portion 18 from the medial area to the lateral area of the heel portion 18 is a heel stabilizer 24 extending away from the platform 20. The heel pedestal 21 extends below the heel stabilizer 24 as illustrated in FIG. 1.

Depending from the platform 20 in the midfoot portion 26 are a medial stabilizer pedestal 28 and a lateral stabilizer pedestal 30. Both pedestals 28, 30 are positioned foreword of the heel stabilizer 24. The medial stabilizer pedestal 28 is positioned beneath the navicular bone (not shown) in order to provide support and control for the joints associated with the navicular. The lateral stabilizer pedestal 30 is positioned below the cuboid bone (not shown) in order to provide support and control for the joints associated with the cuboid. As illustrated in FIG. 2, the medial stabilizer pedestal 28 is generally positioned somewhat forward of the lateral stabilizer pedestal 30. Additionally, both pedestals 28, 30 are positioned to extend laterally beyond the perimeter of the sole 14. This provides an enhanced degree of lateral stability compared to a conventional sole. A rigid bridge 36 couples the heel pedestal 21 with the medial stabilizer pedestal 28 and the lateral stabilizer pedestal 30 to provide an integral, 3-point support structure.

Figure 3:
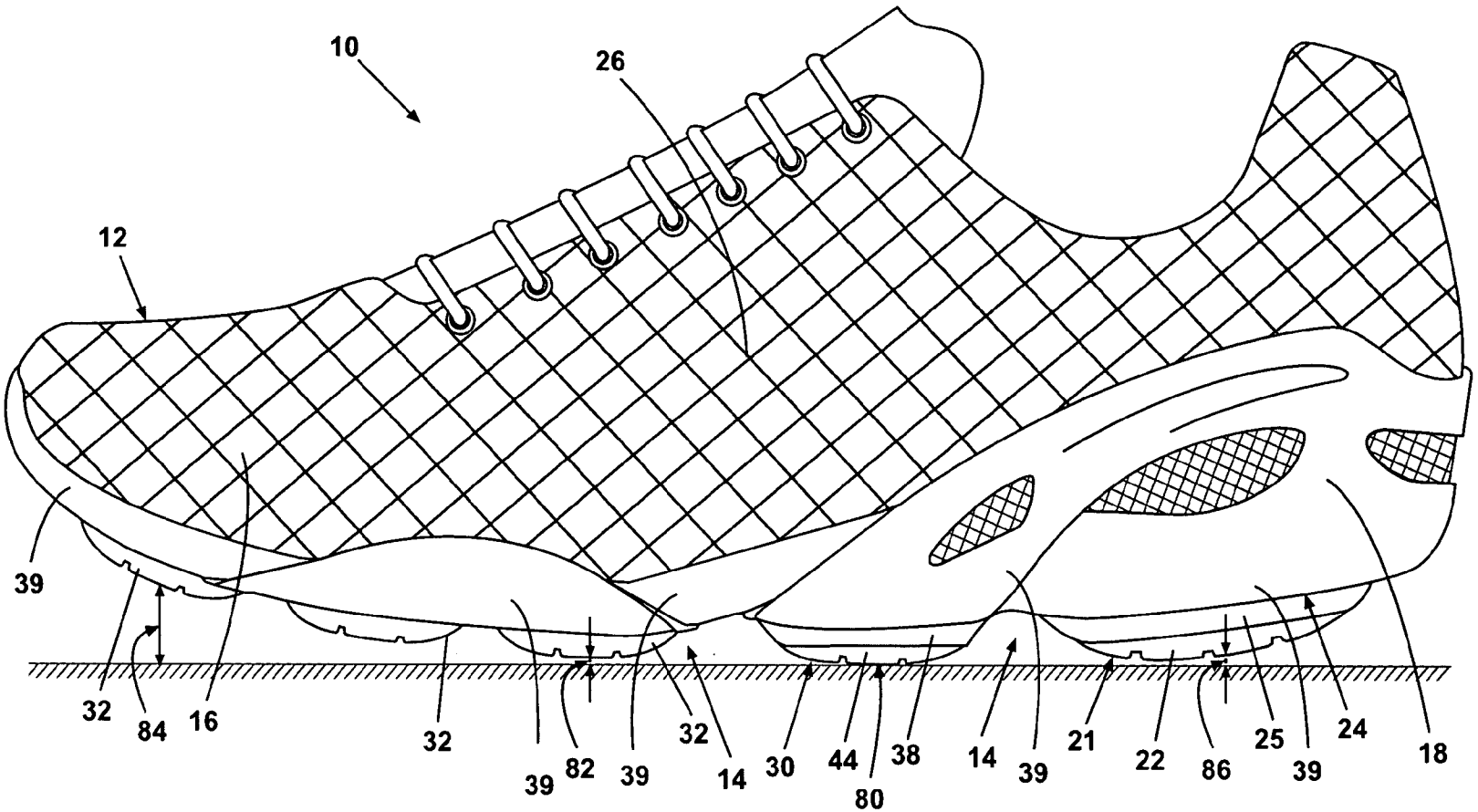
FIG. 3 is a side elevational view of the shoe illustrated in FIG. 1 showing the degree of rocker associated with the shoe.

As illustrated in FIG. 3, the shoe 10 is also configured to provide a selected degree of longitudinal forefoot rocker and heel rocker when the shoe is resting unworn on a horizontal surface. Rocker is defined in terms of the distance of selected reference points above a supporting surface with only the medial stabilizer pedestal 28 and the lateral stabilizer pedestal 30 in contact with the supporting surface. Thus, treating the supporting surface as the base reference line 80 with only the pedestals 28, 30 resting thereon, the intermediate height of the center of the adjacent forefoot support pad 32 will be between 2 and 4 millimeters. The forward height 84 of the center of the most distal forefoot support pad 32 will be between 2 and 3 centimeters, and the heel height 86 of the center of the heel pedestal 21 will be between 3 and 5 millimeters. With this profile, the shoe 10 is supported on the heel pedestal 21, the medial stabilizer pedestal 28, and the lateral stabilizer pedestal 30. This provides a 3-point support base for the user's foot which is highly stable and resistant to foot roll. While a wearer's weight may compress the pedestals 21, 28, 30 so that the forefoot portion 16 contacts the supporting surface, the pedestals 21, 28, 30 will play a significant role in supporting and controlling the wearer's weight during standing and bipedal locomotion.

Figure 5:
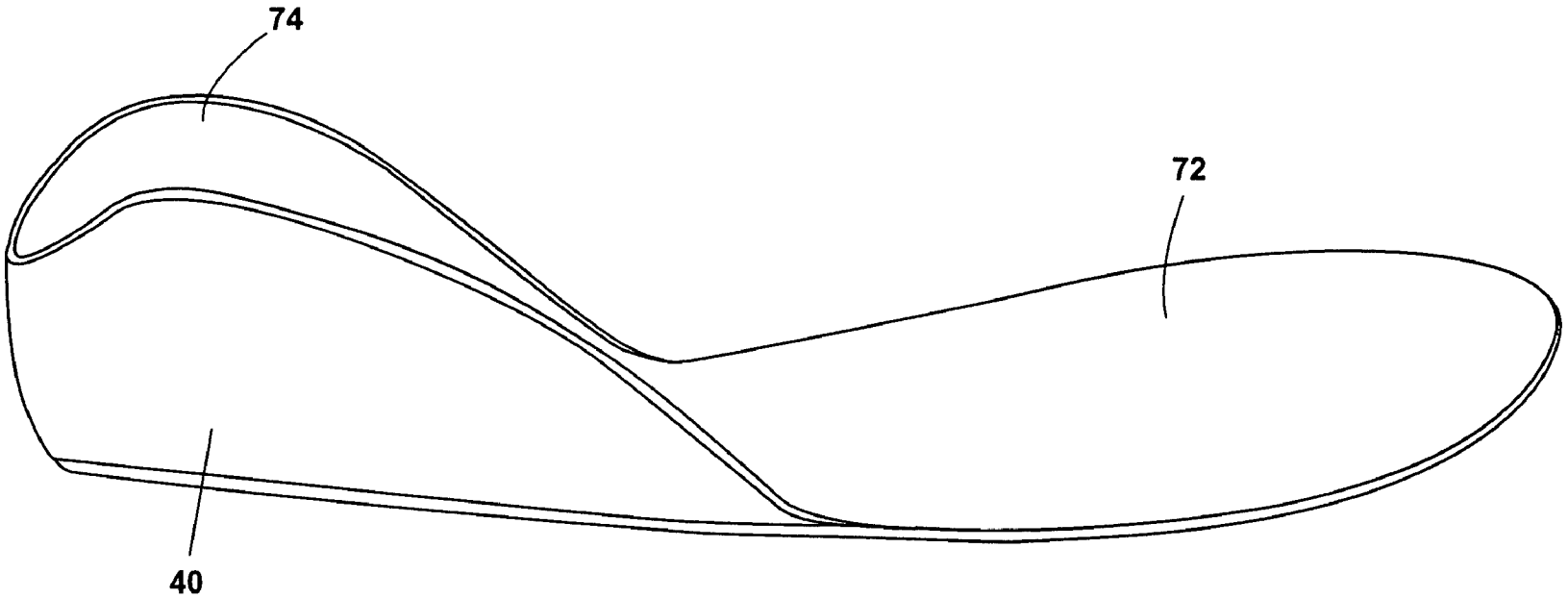
FIG. 5 is a perspective view of a stability shell forming part of the shoe illustrated in FIG. 1.
Figure 6:
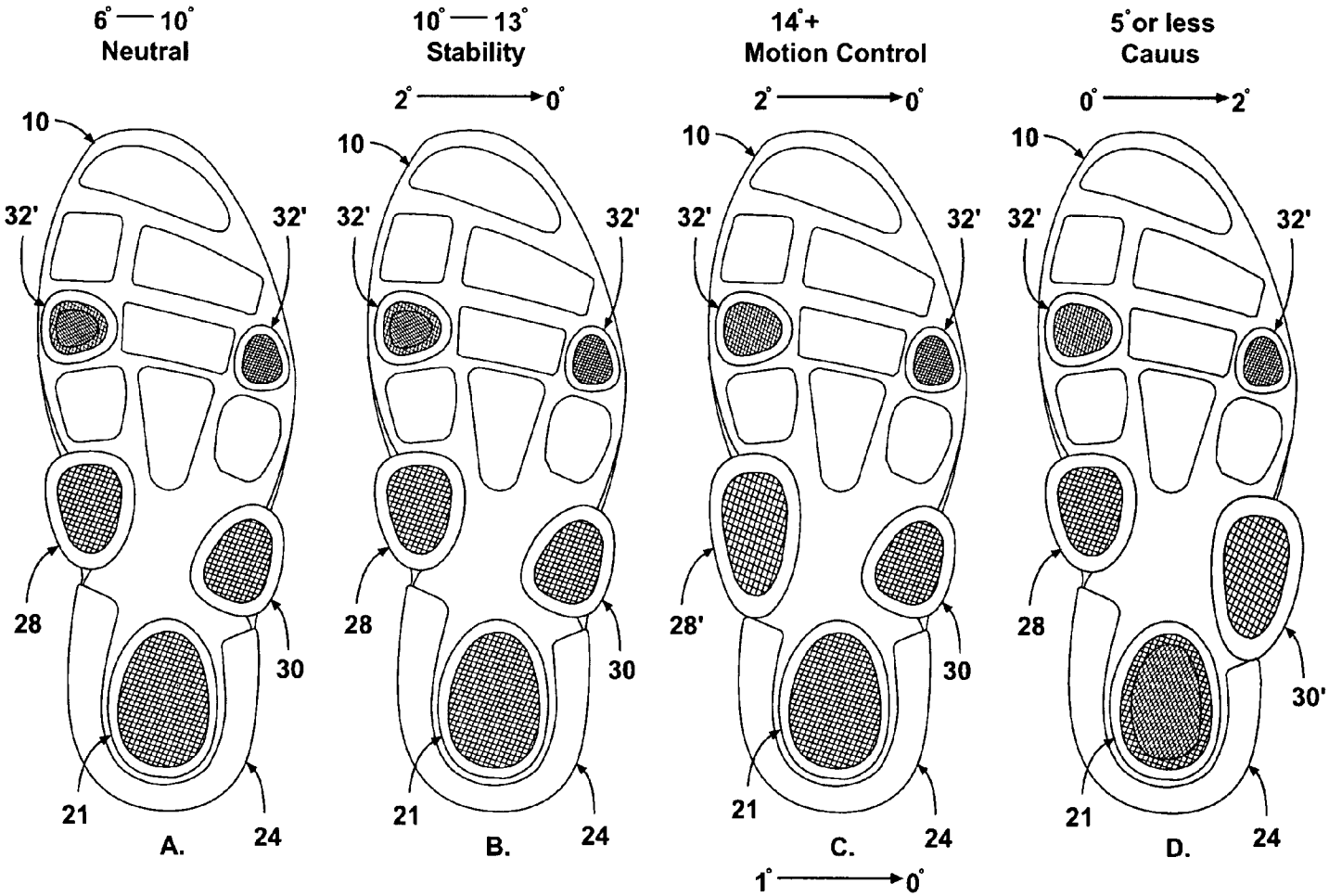
FIG. 6A is a plan view from the underside of the shoe illustrated in FIG. 1 providing a neutral degree of correction.
FIG. 6B is a view is similar to FIG. 6A of a shoe providing correction for a slight degree of late pronation.
FIG. 6C is a view similar to FIG. 6A of a shoe providing correction for an extensive degree of pronation.
FIG. 6D is a view similar to FIG. 6A of a shoe providing correction for supination.

The forefoot rocker is defined in part by a stability shell 40 as illustrated in FIG. 5. The stability shell 40 is a thin, semi-rigid, generally foot-shaped body having a plantar portion 72 and a heel cup 74. The plantar portion 72 can be flat, or can optionally have a somewhat longitudinally upwardly-curved profile. Any curvature of the plantar portion 72 may be adapted to be complementary to the longitudinal forefoot rocker of the shoe 10. The stability shell 40 can be integrated into the shoe 10 between the insole and the outsole. In addition to contributing to a selected degree of forefoot rocker, the stability shell 40 controls foot roll or twisting during bipedal locomotion. This control is provided because the stability shell 40 extends beneath the wearer's entire foot, encompassing the heel and extending to the ends of the toes.

Figure 4:
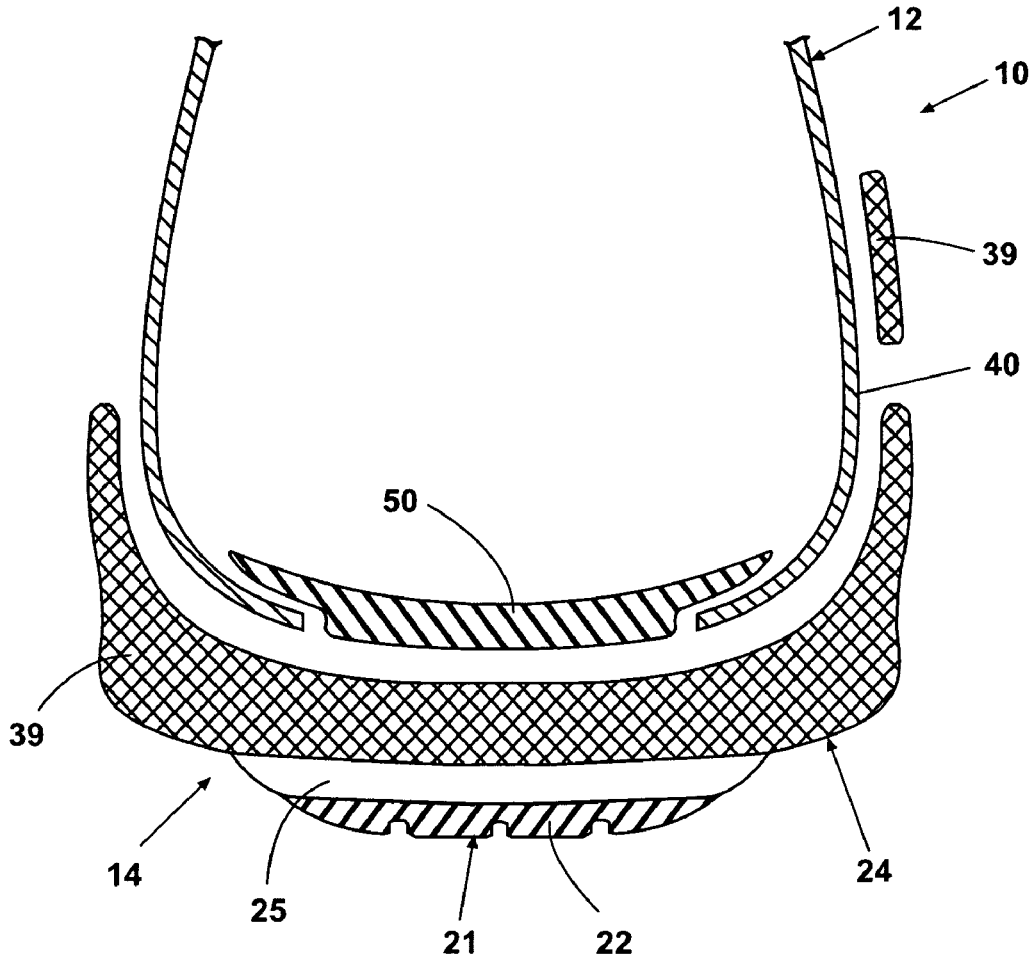
FIG. 4 is a schematic sectional view taken along view line 4-4 of FIG. 1.

FIG. 4 is a somewhat schematic sectional view through the heel portion of the shoe 10 illustrating a construction of the shoe 10. The heel pedestal 21 comprises a heel outsole 22, a highly compressible middle layer 25, and a relatively moderately compressible base layer 39. The heel outsole 22 comprises a tough, wear-resistant material, such as a rubber or other materials commonly used for shoe soles. The heel outsole 22 overlies the middle layer 25, which is fabricated of a compressible material, such as ethylene vinyl acetate (EVA). The middle layer 25 extends from the base layer 39, which is also fabricated of an EVA, but with a higher density and lower compressibility than the middle layer 25. To the inside of the base layer 39 is the stability shell 40. The stability shell 40 can be fabricated of a tough, moderately flexible material, such as a thermoplastic polyurethane (TPU). In the heel cup 74, the stability shell 40 can be configured with a cut-out adapted to receive a cushioning pad fabricated of a suitable cushioning material, such as EVA having a selected density and compressibility, to provide additional cushioning to the heel. Referring again to FIGS. 1 and 3, the base layer 39 can also be extended along the sides of the shoe 10 in a selected configuration to provide abrasion resistance and enhanced support, particularly the of heel.

Referring again to FIGS. 1 and 2, the medial stabilizer pedestal 28 and the lateral stabilizer pedestal 30 are similarly fabricated with a stabilizer pedestal outsole 46, 44, respectively, and a compressible middle layer 38 interposed between the outsole 44, 46 and the base layer 39.

In use, as a person takes a step, the heel is the first part of the foot to make contact with the walking or running surface. The rear portion of the heel stabilizer 24 will be brought into initial contact with the surface, and will compress moderately due to the moderately compressible properties of the heel stabilizer EVA. The compressibility of the heel stabilizer EVA will also contribute to lateral stability of the foot while the heel is supporting much of the wearer's weight. This lateral stability will facilitate a selected transfer of weight from the heel through the midfoot to the forefoot.

As the foot pitches forward, the heel pedestal 21 will contact the surface, and at least a portion of the wearer's weight will be transferred from the heel stabilizer 24 to the heel pedestal 21. The highly compressible midlayer 25 will compress, along with the less compressible base layer 39. The portions of the heel stabilizer 24 along the lateral and medial areas of the heel portion 18 will continue to carry some portion of the wearer's weight to provide lateral stability. However, the heel pedestal 21 will tend to maintain the selected lateral positioning of the heel to align the weight properly with respect to the heel bone. The heel cup 74 will also contribute to the selected positioning of the wearer's heel relative to the heel pedestal 21.

As the foot continues to pitch forward, the wearer's weight will be transferred, first to the lateral stabilizer pedestal 30, then to the medial stabilizer pedestal 28. As the weight is transferred to the lateral stabilizer pedestal 30, the pedestal 30 will compress somewhat, but will control undesirable supination. The relative positioning of the heel pedestal 21 and the lateral stabilizer pedestal 30 will control the early transfer of weight from the heel to the midfoot.

Additional movement will transfer some of the wearer's weight to the medial stabilizer pedestal 28. The medial stabilizer pedestal 28 will compress somewhat, but will control undesirable pronation. The relative positioning of the medial stabilizer pedestal 28 relative to the heel pedestal 21 and the lateral stabilizer pedestal 30 will control the progressive transfer of weight from the heel through the midfoot to the forefoot. FIG. 2 illustrates one configuration and positioning of the stabilizer pedestals 28, 30. The anticipated use of the shoe, e.g. athletics, casual wear, etc., may dictate variations in size, configuration, and placement of the stabilizer pedestals 28, 30 beyond that illustrated in FIG. 2.

At some point in the movement, the wearer's weight will be supported entirely on the 3-point support base consisting of the heel pedestal 21 the medial stabilizer pedestal 28, and the lateral stabilizer pedestal 30. This will properly orient the wearer's foot for transfer of the wearer's weight to the forefoot, thereby maintaining a selected gait without excessive pronation or supination. As the step is completed, and the person's weight is transferred to the forefoot, the forefoot support pads 32 will provide selected support to the individual bones in the plantar region of the foot, further controlling pronation or supination and facilitating maintenance of a selected gait.

FIGS. 6A-D illustrate 4 general conditions relating to foot orientation and gait in the context of the shoe described herein. The Figures illustrate 4 plan views of the sole of the shoe 10 for addressing the 4 conditions. Each condition is defined by the results of a calcaneal eversion measurement, such as taken with a subtalar joint goniometer (not shown) as described in Applicant's U.S. Pat. No. 7,069,665. Thus, for example, FIG. 6A relates to a calcaneal eversion measurement of 6-10°, FIG. 6B relates to a calcaneal eversion measurement of 10-13°, FIG. 6C relates to a calcaneal eversion measurement of 14° or greater, and FIG. 6D relates to a calcaneal eversion measurement of 5° or less. These are also referred to, respectively, as "neutral," "stability," "motion control," and "cavus." After determining whether a patient's foot presents as "neutral," "stability," "motion control," or "cavus," the shoe 10 can be further adjusted to accommodate each condition.

With a "neutral" condition, no further adjustment to the shoe is necessary. With a "stability" condition, also referred to as "late pronation," the shoe can be adjusted by raising the medial edge of the forefoot portion approximately 2° by a wedge or similar structure extending along the medial region of the forefoot portion from the forward end of the shoe to just forward of the medial stabilizer pedestal 28. The lateral edge is not raised. This will provide a lateral inclination of the forefoot portion ranging from zero to 2° across the forefoot portion toward the medial edge.

With a "motion control" condition, also referred to as "severe pronation," the shoe is adjusted by raising the medial edge of the forefoot portion approximately 2°, and the medial edge of the heel portion approximately 1°, by one or more wedges or similar structures. A single wedge can extend along the medial portion of the sole from the forefoot portion 16 to the heel portion 18 to provide a selected adjustment. The lateral edges are not raised. The wedge will provide a lateral inclination of the forefoot portion ranging from zero to 2° toward the medial edge, and a lateral inclination of the heel portion ranging from zero to 1° across the heel portion toward the medial edge. Additionally, the medial stabilizer pedestal 28' can be appropriately enlarged.

With a "cavus" condition, the shoe can be adjusted by raising the lateral edge of the forefoot portion approximately 2° by a wedge or similar structure extending along the lateral region of the forefoot portion from the forward end of the shoe to just forward of the lateral stabilizer pedestal 30. Additionally, the lateral stabilizer pedestal 30' can be appropriately enlarged. The medial edge of the forefoot portion is not raised. Adjustments to address the "cavus" condition will tend to control supination. The wedge will provide a lateral inclination of the forefoot portion ranging from zero to 2° toward the lateral edge.

Further refinements of the adjustments described above can be achieved by selected adjustments in selected forefoot support pads 32', such as size, height, compressibility, location, and the like.

Figure 7:
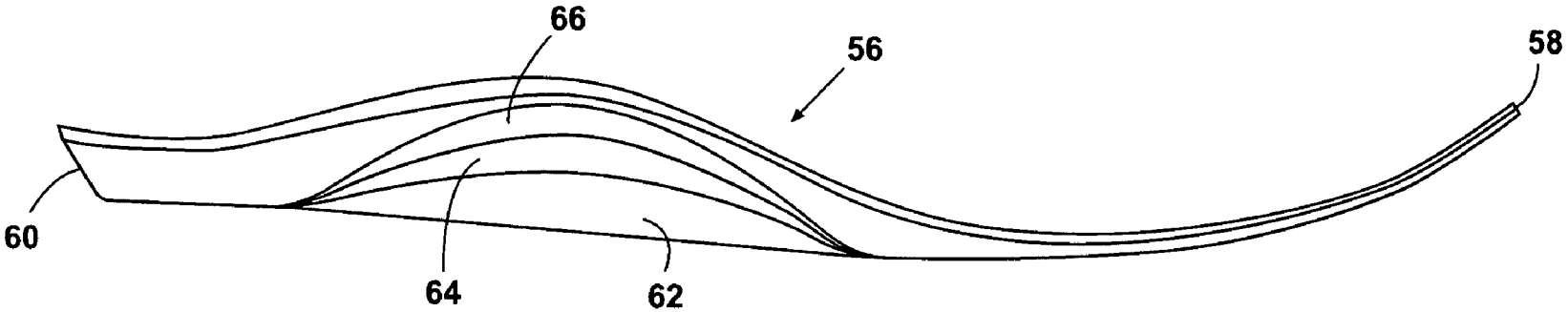
FIG. 7 is a side elevational view of an arch adjustment support for utilization in the shoe illustrated in FIG. 1 showing 3 progressively effective configurations.

As illustrated in FIG. 7, the shoe 10 can also be fitted with an arch support insert 56 comprising a forward end 58 extending to the ends of the toes, and a heel end 60 beneath the heel. The insert 56 can be provided with a low arch profile 62, a medium arch profile 64, or a high arch profile 66, based upon a selected arch profile appropriate for the person to whom the shoe 10 is being fitted. Alternatively, the stability shell 40 can be modified to include a selected arch profile. The insert 56 or stability shell 40 can thereby provide further support to the foot and control of the wearer's gait.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A shoe having a sole including a platform for supporting a wearer's foot upon a surface, the shoe comprising:

a heel pedestal extending from the platform beneath a wearer's heel;

a lateral stabilizer pedestal extending from the platform at least partially beneath a wearer's cuboid bone; and a medial stabilizer pedestal extending from the platform at least partially beneath a wearer's navicular bone;

wherein the heel pedestal, the lateral stabilizer pedestal, and the medial stabilizer pedestal include an outsole for contacting the surface, a compressible middle layer between the outsole and the wearer's foot, and a base layer between the middle layer and the wearer's foot having a compressibility lower than the compressibility of the middle layer.

2. A shoe according to claim 1 wherein the compressible middle layer comprises an ethylene vinyl acetate.

3. A shoe according to claim 1, and further comprising a heel stabilizer extending at least partially along the perimeter of the heel portion.

4. A shoe according to claim 3 wherein the heel stabilizer is integral with the base layer.

5. A shoe according to claim 3 wherein the heel stabilizer comprises the same material as the base layer.

6. A shoe according to claim 1, and further comprising a stability shell having a plantar portion for supporting a wearer's forefoot, and a heel cup for cradling a wearer's heel.

7. A shoe according to claim 6 wherein the stability shell is integral with the sole.

8. A shoe for supporting a wearer's foot upon a surface, the shoe comprising:

a sole including a forefoot portion associated with a plantar region of a wearer's foot, a midfoot portion associated with a wearer's arch, and a heel portion associated with a wearer's heel;

a lateral stabilizer pedestal extending from the midfoot portion at least partially beneath a wearer's cuboid bone;

a medial stabilizer pedestal extending from the midfoot portion at least partially beneath a wearer's navicular bone;

a heel pedestal extending from the heel portion beneath a wearer's heel; and an array of forefoot support pads including at least a first forefoot support pad adjacent the lateral stabilizer pedestal and the medial stabilizer pedestal, and a second forefoot support pad adjacent the front of the shoe, the array of forefoot support pads integrated into and extending from the forefoot portion;

wherein, with the unworn shoe supported on a reference surface by the lateral stabilizer pedestal and the medial stabilizer pedestal, a first height is defined by a distance between the reference surface and the center of a ground contacting surface of the forefoot support pad adjacent the lateral stabilizer pedestal and the medial stabilizer pedestal, a second height is defined by a distance between the reference surface and the center of a ground contacting surface of the forefoot support pad adjacent the front of the shoe, and the second height is greater than the first height, and a third height is defined by a distance between the reference surface and the center of a ground contacting surface of the heel pedestal, and the third height is less than the second height; and wherein the first, second, and third heights define a longitudinal profile characterizing a forefoot rocker and a heel rocker, and enabling the heel pedestal, the medial stabilizer pedestal, and the lateral stabilizer pedestal to define an integral, 3-point structure for supporting a wearer's foot.

9. A shoe according to claim 1, and further comprising a bridge coupling the heel pedestal, the medial stabilizer pedestal, and the lateral stabilizer pedestal into an integral, 3-point structure for supporting a wearer's foot.

10. A shoe according to claim 8, and further comprising a bridge coupling the heel pedestal, the medial stabilizer pedestal, and the lateral stabilizer pedestal into the integral, 3-point structure.

* * * * *